US006310026B1

(12) United States Patent
Shintani et al.

(10) Patent No.: US 6,310,026 B1
(45) Date of Patent: Oct. 30, 2001

(54) METHOD OF CLEANING AND SURFACE PROCESSING OF INORGANIC FILLER UTILITY

(75) Inventors: Hideaki Shintani; Masayuki Okazaki; Yasuhiro Yoshida; Kenichi Shirai, all of Hiroshima (JP); Bart Van Meerbeek, Heverlee (BE); Daisuke Usuki, Tokyo (JP)

(73) Assignee: GC Corporation, Tokyo (JP)

( * ) Notice: Subject to any disclaimer, the term of this patent is extended or adjusted under 35 U.S.C. 154(b) by 0 days.

(21) Appl. No.: 09/813,802

(22) Filed: Mar. 22, 2001

(30) Foreign Application Priority Data

Mar. 24, 2000 (JP) ..... 12-084506

(51) Int. Cl.[7] ..... C11D 3/00

(52) U.S. Cl. ..... 510/375; 510/109; 510/116; 510/511

(58) Field of Search ..... 510/109, 375, 510/511, 116

(56) References Cited

U.S. PATENT DOCUMENTS 6,117,783 * 9/2000 Small et al. ..... 438/693

* cited by examiner

*Primary Examiner*—Mark Kopec
*Assistant Examiner*—John M Petruncio
(74) *Attorney, Agent, or Firm*—Oblon, Spivak, McClelland, Maier & Neustadt, P.C.

(57) ABSTRACT

A method of cleaning of an inorganic filler, upon which the inorganic filler used in resin materials for industrial or biological use, particularly dental resin restorative materials, can be more firmly bound to a resin matrix as a substrate, as well as a method of surface processing of the inorganic filler, are provided. The inorganic filler surface is cleaned with an aqueous solution of a peroxo acid and/or a peroxo acid salt, washed with water, and then cleaned with an organic solvent. Further, the cleaned inorganic filler is subjected to a silane coupling processing, thereby the inorganic filler being processed.

5 Claims, No Drawings

METHOD OF CLEANING AND SURFACE PROCESSING OF INORGANIC FILLER UTILITY

BACKGROUND OF THE INVENTION

1. Field of the Invention

The present invention relates to a method of cleaning of an inorganic filler in resin-based materials, and to a method for surface treatment of the inorganic filler after cleaning. The proposed methods should be applied resin-based materials for industrial or biological use, particularly dental resin restorative materials such as dental resin composite, resin-based adhesives, cements, resin-made tooth crown prostheses, and denture base resins, in order to bind an inorganic filler firmly to a resin matrix.

2. Description of the Conventional Art

Dental resin restorative materials represented by resin composite and resin-based adhesives, cements have been widely used in dentistry. These materials are generally composed of inorganic filler particles blended into a resin matrix, as a substrate to enhance the strength of the dental resin restorative after curing. As a method for enhancing the strength of the dental resin restorative, is employed a method in which in order to bind an inorganic filler to be formulated into the dental resin restorative materials more firmly to a resin matrix, the inorganic filler is subjected to a silane coupling processing.

In the inorganic filler used for the dental resin restorative material, the strength and surface properties of the dental resin restorative after curing vary depending on the particle size thereof. Although, inorganic fillers having a particle size of from several tens $\mu$m to several hundreds $\mu$m have been used for the conventional dental resin restorative materials, in recent years, microfine inorganic fillers having a particle size of about 0.04 to 5 $\mu$m are mainly used in the dental resin restorative material, resulting in increase of a specific surface area of the inorganic filler in the dental resin restorative material.

It has been indicated that organic substances, such as carbon, which are considered to attach during the production or storage of the inorganic filler, i.e., contaminants on the inorganic filler surface, adversely affect the binding between the inorganic filler and the resin matrix strongly. These contaminants weaken the binding between the inorganic filler and the resin matrix. In addition, they inhibit the binding of a silane coupling agent onto the inorganic filler surface. Thus, a cleaning method for removing surely the contaminants from the inorganic filler is being investigated.

As a conventional cleaning method for inorganic fillers, a cleaning method in which water or a solvent has been generally applied, to remove contaminants by utilizing its dissolving power or diffusing power, has been generally employed. Water, low-boiling point paraffinic hydrocarbons, high-boiling point petroleum hydrocarbons, alcohols, or surfactants are mainly used in this method. However, water has a low dissolving power to oily organic substances, so that sufficient cleaning effects cannot be expected; and although the low-boiling point paraffinic hydrocarbons have a high dissolving power to oily organic substances, they involve problems against ignition or explosion during the use. Also, the high-boiling point petroleum hydrocarbons have such defects that a dissolving power to oily organic substances is low and that their removal and drying after the cleaning are difficult. Further, the alcohols are not effective against oily organic substances, have risks of ignition or explosion during the use, as well as the low-boiling point paraffinic hydrocarbons. Although the surfactants can remove oily organic substances or aqueous stains to some extent, it is difficult to remove the surfactants themselves after the cleaning.

As described above, a special attention is required to the handling for the conventional cleaning methods of inorganic filler. In addition, contaminants on the inorganic filler surface cannot be thoroughly removed, thus, it is pointed out that the binding between the inorganic filler and the resin matrix is insufficient, resulting in low durability of the dental resin restorative used in an oral cavity for a long period. In other words, the strength of the dental resin material is gradually lowered.

SUMMARY OF THE INVENTION

An object of the present invention is to develop a method of cleaning of an inorganic filler, upon which the inorganic filler used in resin materials for industrial or biological use, particularly dental resin restorative materials, can be more firmly bound to a resin matrix as well as a method of surface processing of the inorganic filler.

In order to solve the above-mentioned object, we, the present inventors made extensive and intensive investigations. As a result, it has been found that when, in cleaning of an inorganic filler, the removal of organic substances, such as carbon, on a surface of the organic filler is carried out with an aqueous solution of a peroxo acid and/or a peroxo acid salt, the danger as seen in the low-boiling point paraffinic hydrocarbons, the alcohols, and soon, is low, and the organic substances, such as carbon, on the inorganic filler surface can be surely removed, and further that when a surface processing with a silane coupling agent is carried out subsequently, the inorganic filler can be bound more firmly to the resin matrix, leading to accomplishment of the present invention.

More specifically, the method of cleaning of an inorganic filler according to the invention is a method of cleaning of an inorganic filler, which comprises cleaning of a surface of an inorganic filler with an aqueous solution of a peroxo acid and/or a peroxo acid salt, washing of the cleaned inorganic filler with water, and then cleaning of it with an organic solvent.

Further, the inventors have found that more preferred results are obtained when an aqueous solution of a peroxo acid and/or a peroxo acid salt having a concentration of 0.001% by weight to 10 by weight is used as the aqueous solution, and further, when sodium peroxodisulfate is used as the peroxo acid salt.

Moreover, the method of surface processing of an inorganic filler according to the invention is a method of surface processing of an inorganic filler, which comprises subjecting of the inorganic filler cleaned by the above-mentioned method to a silane coupling processing.

DETAILED DESCRIPTION OF THE INVENTION

In the method of cleaning of the inorganic filler and the method of surface processing of the cleaned inorganic filler according to the invention, the inorganic filler is, first of all, cleaned with a solution of a peroxo acid and/or a peroxo acid salt. Specific examples of the inorganic filler, which is applied to the method of cleaning of the inorganic filler and the method of surface processing of the cleaned inorganic filler according to the invention, include quartz, colloidal silica, feldspar, alumina, strontium glass, barium glass, borosilicate glass, titania, and fluoroaluminosilicate glass. Further, the methods of the invention can also be applied to organic-inorganic composite fillers prepared by mixing of the above-mentioned inorganic filler with a resin matrix, polymerizing and curing of the mixture, and then pulverizing of the cured product.

Examples of the peroxo acid and/or the peroxo acid salt, which can be used in the method of cleaning of the inorganic filler and the method of surface processing of the cleaned inorganic filler according to the invention include sodium peroxodicarbonate, potassium peroxodicarbonate, peroxodisulfuric acid, sodium peroxodisulfate, potassium peroxodisulfate, peroxophosphoric acid, sodium peroxophosphate, and potassium peroxophosphate. The aqueous solution of the peroxo acid and/or the peroxo acid salt has preferably a concentration of the peroxo acid and/or the peroxo acid salt of 0.001% by weight to 10% by weight, and more preferably 0.05% by weight to 10% by weight. In the case where the concentration is lower than 0.001% by weight, the cleaning effects are low, so that the characteristics of the invention tend to be hardly obtained. On the other hand, even when an aqueous solution having a concentration exceeding 10% by weight is used, more high effects cannot be obtained.

In the method of cleaning of the inorganic filler and the method of surface processing of the inorganic filler after cleaning, with the solution of the peroxo acid and/or the peroxo acid salt according to the invention, even cleaning at room temperature can provide sufficient effects. However, it is preferred that the cleaning is carried out at a cleaning temperature of 30° C. to 120° C. for a cleaning time of about 3 minutes to about 180 minutes.

The cleaning temperature and the cleaning time are properly set depending upon the type of the peroxo acid and/or the peroxo acid salt used, the type and shape of the inorganic filler to be used, and the total amount to be cleaned. For example, in the case where 600 g of spherical quarts having a mean particle size of 4 $\mu$m is cleaned with 3,000 g of a 5% aqueous solution of sodium peroxodisulfate, it is preferred that the cleaning is carried out at atmospheric pressure and at 100° C. for 20 minutes.

The inorganic filler as cleaned with the peroxo acid and/or the peroxo acid salt is washed with water from which impurities have been thoroughly removed and then cleaned with an organic solvent such as acetone and ethanol, thereby the peroxo acid and/or the peroxo acid salt remaining on the inorganic filler surface being surely removed from the inorganic filler.

In this case, in order to efficiently remove the peroxo acid and/or the peroxo acid salt remaining on the inorganic filler surface, it is preferred to carry out the cleaning by means of an ultrasonic cleaning unit in combination.

The method of surface processing of the inorganic filler according to the present invention is a method in which the inorganic filler, which has been cleaned with the solution of the peroxo acid and/or the peroxo acid salt, washed with water and then cleaned with the organic solvent, is subjected to a silane coupling processing. The silane coupling processing can be carried out by employing conventional silane coupling processing methods such as pre-processing methods including a dry type processing method and a wet type processing method, or an integral blending method. The dry type processing method as referred to herein is a method in which the inorganic filler is charged into a high-speed mixer (such as a Henschel mixer or a super mixer); a silane or a silane solution is added thereto dropwise or by a sprayer, while it being stirred at a high speed, to form a uniform mixture; and the mixture is then dried. The wet type processing method as referred to herein is a method in which the inorganic filler is dispersed in water or an organic solvent to form a slurry, to which is then added a silane coupling agent with stirred. As a matter of course, it is not to be construed that the method of the silane coupling processing that is carried out in the surface processing method of the inorganic filler according to the invention is limited to the methods described above.

In the surface processing method of the inorganic filler according to the invention, the silane coupling agent to be used for the silane coupling processing is a polymerizable, ethylenically unsaturated double bond-containing organic compound. Examples of the polymerizable, ethylenically unsaturated double bond-containing organic compound that can be used for the silane coupling agent include vinyl-based silane coupling agents such as vinyl trimethoxysilane, vinyl triethoxysilane, γ-methacryloxypropyl trimethoxy-silane, γ-methacryloxypropylmethyl dimethoxysilane, vinyl trichlorosilane, and vinyl tris(2-methoxy-ethoxy)silane.

The method of cleaning of the inorganic filler and the method of surface processing of the cleaned inorganic filler according to the present invention can be applied to resin materials for industrial or biological use, particularly dental resin restoratives. Specifically, the methods according to the present invention can be applied to industrial resin materials such as scagliolas and molding resin materials for mechanical members, or biological resin materials such as artificial bones and bone cements, and especially dental resin restorative materials such as dental resin composites, resin-based adhesives, cements, resin-made tooth crown prostheses, and denture base resins.

The method of cleaning of the inorganic filler and the method of surface processing of the cleaned inorganic filler according to the present invention will be described below with reference to the following Examples, but it should not be construed that the invention is limited thereto.

EXAMPLE 1

Powdered silica (a trade name: Crystalite VX-S, made by Tatsumori Ltd.) having a mean particle size of 4 $\mu$m as an inorganic filler was cleaned with each of aqueous solutions of a peroxo acid and/or a peroxo acid salt of Examples 1-1 to 1-10 as shown in Table 1, subjected to ultrasonic washing with water (for 30 minutes) and filtration twice, and then subjected to ultrasonic cleaning with acetone (for 30 minutes). Thereafter, the inorganic filler was dried at 120° C. for 2 hours and subjected to a silane coupling processing in a dry type processing method with 1 g of γ-methacryloxypropyl trimethoxysilane per 100 g of the powdered silica.

After cleaning and surface processing, a dental composite resin was prepared with 75% by weight of the silane coupling-processed powdered silica, 17% by weight of di-2-methacryloyloxyethyl 2,2,4 -trimethylhexa-methylene dicarbamate, 6% by weight of triethylene glycol dimethacrylate, 0.5% by weight of camphorquinone, and 1.5% by weight of ethyl p-dimethylaminobenzoate, whose durability was then evaluated from a degree of reduction of three points bending strength after a thermal cycle test.

Thermal Cycling Test

The dental resin composite as prepared in each of the Examples and Comparative Examples was charged into a mold having a size of 25 mm×2 mm×2 mm and brought into press contact with a glass sheet having a size such that it could completely cover the mold. Both surfaces of the dental resin composite were irradiated for curing with light for 5 minutes by means of a light curing unit (a trade name: LABOLIGHT VL-II, made by GC Corporation). The resulting test sample was subjected to a thermal cycling and evaluated in terms of a degree of reduction of three points bending strength of the dental resin composite after the thermal cycling, from a value of the three points bending strength as measured before thermal cycling and a value of the three points bending strength after the thermal cycling. Wherein, a thermal cycling test in which the test specimen was alternately dipped in water at 4° C. and 60° C. for one minute respectively was repeated 2,000 times. The measurement results are shown in Table 1.

TABLE 1

| | Cleaning conditions | | | | Degree of reduction of three points bending |
|---|---|---|---|---|---|
| | Substance used | Concentration | Temperature | Time | strength (%) |
| Example 1-1 | Peroxodisulfuric acid | 5% | 25° C. | 30 min. | 3.7 |
| Example 1-2 | Sodium peroxodisulfate | 1% | 80° C. | 30 min. | 2.2 |
| Example 1-3 | | 2% | 80° C. | 30 min. | 2.3 |
| Example 1-4 | | 0.02% | 25° C. | 30 min. | 2.2 |
| Example 1-5 | | 5% | 80° C. | 30 min. | 1.5 |
| Example 1-6 | | 5% | 35° C. | 60 min. | 1.9 |
| Example 1-7 | | 10% | 80° C. | 30 min. | 1.9 |
| Example 1-8 | Potassium peroxodisulfate | 5% | 50° C. | 30 min. | 2.6 |
| Example 1-9 | | 5% | 50° C. | 30 min. | 2.8 |
| Example 1-10 | Sodium peroxophosphate | 5% | 80° C. | 30 min. | 1.8 |
| Comparative Example 1-1 | — | — | — | — | 15.8 |
| Comparative Example 1-2 | Water | — | 80° C. | 60 min. | 15.4 |
| Comparative Example 1-3 | Ethanol | 100% | 40° C. | 60 min. | 12.0 |
| Comparative Example 1-4 | Sodium dodecylsulfate | 5% | 80° C. | 60 min. | 12.5 |
| Comparative Example 1-5 | Hydrochloric acid | 1% | 25° C. | 30 min. | 12.7 |
| Comparative Example 1-6 | Sodium hydroxide | 5% | 25° C. | 30 min. | 11.9 |

Comparative Example 1

Powdered silica was not cleaned, or powdered silica was cleaned with water or each of aqueous solutions of ethanol, sodium dodecylsulfate, hydrochloric acid, and sodium hydroxide in place of the aqueous solution of a peroxo acid and/or a peroxo acid salt as shown, in Comparative Examples 1-1 to 1-6 in Table 1, followed by washing with water, cleaning with acetone and then drying. Thereafter, by following the same procedures as in Example 1, a silane coupling processing was carried out, and a dental resin composite was prepared and subjected to a thermal cycling test to evaluate the durability. The results obtained are shown in Table 1.

EXAMPLE 2

Comparative Example 2

In Examples 2-1 to2-10, powdered barium glass (made by SCHOTT) having a mean particle size of 4.5 μm as an inorganic filler was cleaned in the same manner as in Example 1, followed by washing with water, cleaning with acetone and drying in the same manner as in Example 1. Then the powdered barium glass was subjected to a silane coupling processing in a dry type processing method with 1 g of γ-methacryloxypropyl trimethoxysilane per 100 g of the powdered barium glass. Thereafter, a dental resin composite having the same formulation as in Example 1 except for the powdered silica having been replaced by the powdered barium glass was prepared and evaluated for durability by means of a thermal cycling test in the same procedures as in Example 1. Further, as Comparative Example 2, the cleaning in Comparative Examples 2-1 to 2-6 was carried out in the same manner as in Comparative Example 1, followed by washing with water, cleaning with acetone and then drying. Thereafter, a silane coupling-processed dental resin composite was prepared and evaluated for durability by means of a thermal cycling test in the same procedures as in Example 2. The measurement results are shown in Table 2.

TABLE 2

| | Cleaning conditions | | | | Degree of reduction of three points bending |
|---|---|---|---|---|---|
| | Substance used | Concentration | Temperature | Time | strength (%) |
| Example 2-1 | Peroxodisulfuric acid | 5% | 25° C. | 30 min. | 3.0 |
| Example 2-2 | Sodium | 1% | 80° C. | 30 min. | 2.4 |
| Example 2-3 | peroxodisulfate | 2% | 80° C. | 30 min. | 2.2 |
| Example 2-4 | | 0.02% | 25° C. | 30 min. | 2.2 |
| Example 2-5 | | 5% | 30 min. | 2.0 | |
| Example 2-6 | | 5% | 35° c. | 60 min. | 2.1 |
| Example 2-7 | | 10% | 80° C. | 30 min. | 2.1 |
| Example 2-8 | Potassium | 5% | 50° C. | 30 min. | 2.5 |
| Example 2-9 | peroxodisulfate | 5% | 50° C. | 30 min. | 2.6 |
| Example 2-10 | Sodium peroxophosphate | 5% | 80° C. | 30 min. | 2.2 |
| Comparative Example 2-1 | — | — | — | — | 16.0 |
| Comparative Example 2-2 | Water | — | 80° C. | 60 min. | 15.9 |
| Comparative Example 2-3 | Ethanol | 100% | 40° C. | 60 min. | 12.3 |
| Comparative Example 2-4 | Sodium dodecylsulfate | 5% | 80° C. | 60 min. | 13.0 |
| Comparative Example 2-5 | Hydrochloric acid | 1% | 25° C. | 30 min. | 12.5 |
| Comparative Example 2-6 | Sodium hydroxide | 5% | 25° C. | 30 min. | 11.9 |

EXAMPLE 3

Comparative Example 3

In Examples 3-1 to 3-10, powdered silica (a trade name: Crystalite VX-S, made by Tatsumori Ltd.) having a mean particle size of 4 $\mu$m as an inorganic filler was cleaned in the same manner as in Example 1, followed by washing with water, cleaning with acetone and then drying in the same manner as in Example 1. Then that the powdered silica was subjected to a silane coupling processing in a dry type processing method with 1 g of γ-methacryloxypropylmethyl dimethoxysilane per 100 g of the powdered silica. Thereafter, a dental resin composite having the same formulation as in Example 1 was prepared and evaluated for durability by means of a thermal cycling test in the same procedures as in Example 1. Further, as Comparative Example 3, the cleaning in Comparative Examples 3-1 to 3-6 was carried out in the same manner as in Comparative Example 1, followed by washing with water, cleaning with acetone and then drying. Thereafter, a silane coupling-processed dental resin composite was prepared and evaluated for durability by means of a thermal cycling test in the same procedures as in Example 3. The measurement results are shown in Table 3.

TABLE 3

| | Cleaning conditions | | | | Degree of reduction of three points bending |
|---|---|---|---|---|---|
| | Substance used | Concentration | Temperature | Time | strength (%) |
| Example 3-1 | Peroxodisulfuric acid | 5% | 25° C. | 30 min. | 2.7 |
| Example 3-2 | Sodium | 1% | 80° C. | 30 min. | 1.9 |
| Example 3-3 | peroxodisulfate | 2% | 80° C. | 30 min. | 2.1 |
| Example 3-4 | | 0.02% | 25° C. | 30 min. | 2.4 |
| Example 3-5 | | 5% | 80° C. | 30 min. | 1.9 |
| Example 3-6 | | 5% | 35° C. | 60 min. | 2.3 |
| Example 3-7 | | 10% | 80° C. | 30 min. | 2.4 |
| Example 3-8 | Potassium | 5% | 50° C. | 30 min. | 3.3 |
| Example 3-9 | Peroxodisulfate | 5% | 50° C. | 30 min. | 3.6 |
| Example 3-10 | Sodium peroxophosphate | 5% | 80° C. | 30 min. | 2.5 |
| Comparative Example 3-1 | — | — | — | — | 15.5 |
| Comparative Example 3-2 | Water | — | 80° C. | 60 min. | 15.3 |
| Comparative Example 3-3 | Ethanol | 100% | 40° C. | 60 min. | 11.3 |
| Comparative Example 3-4 | Sodium dodecylsulfate | 5% | 80° C. | 60 min. | 11.2 |
| Comparative Example 3-5 | Hydrochloric acid | 1% | 25° C. | 30 min. | 10.8 |
| Comparative Example 3-6 | Sodium hydroxide | 5% | 25° C. | 30 min. | 11.0 |

As have described in detail, by the method of cleaning of the inorganic filler and the method of surface processing of the cleaned inorganic filler according to the present invention, contaminants, such as carbon, on the inorganic filler surface can be surely removed. Further, it can be confirmed that the silane coupling agent used during the silane coupling processing is chemically bound more firmly onto the inorganic filler surface, whereby the durability of the dental resin restorative with the thus processed inorganic filler is improved.

In the light of the above, the method of cleaning of the inorganic filler and the method of surface processing of the cleaned inorganic filler according to the present invention enable the inorganic filler to be formulated into the dental restorative material to bind more firmly to a resin matrix as a substrate by being cleaned and further subjected to a silane coupling processing. Also, dental restorative materials that are free from a reduction in strength even after use in an oral cavity for a long period of time can be provided. Thus, the invention greatly contributes to the dental remedy.

While the invention has been described in detail and with reference to specific embodiments thereof, it will be apparent to one skilled in the art that various changes and modifications can be made therein without departing from the spirit and scope thereof.

What is claimed is:

1. A method of cleaning of an inorganic filler, which comprises cleaning of an inorganic filler surface with an aqueous solution of peroxo acid and/or a peroxo acid salt, washing of the cleaned inorganic filler with water, and then cleaning of it with an organic solvent.

2. The method for cleaning of an inorganic filler as claimed in claim 1, wherein the aqueous solution of peroxo acid and/or peroxo acid salt has a concentration of 0.001% by weight to 10% by weight.

3. The method for cleaning of an inorganic filler as claimed in claim 1, wherein the peroxo acid salt is sodium peroxodisulfate.

4. The method for cleaning of an inorganic filler as claimed in claim 2, wherein the peroxo acid salt is sodium peroxodisulfate.

5. A method of surface processing of an inorganic filler, which comprises subjecting the inorganic filler cleaned by the method as claimed in any one of claims 1 to 4 to a silane coupling processing.

* * * * *

UNITED STATES PATENT AND TRADEMARK OFFICE

CERTIFICATE OF CORRECTION

PATENT NO. : 6,310,026 B1
DATED : October 30, 2001
INVENTOR(S) : Shintani et al.

It is certified that error appears in the above-identified patent and that said Letters Patent is hereby corrected as shown below:

Title page, Item [54], Column 1,
The title should be:
[54] METHOD OF CLEANING AND SURFACE PROCESSING OF INORGANIC FILLER

Signed and Sealed this

Twelfth Day of March, 2002

*Attest:*

*Attesting Officer*

JAMES E. ROGAN
*Director of the United States Patent and Trademark Office*